United States Patent [19]

Wochnik

[11] Patent Number: 4,736,607

[45] Date of Patent: Apr. 12, 1988

[54] APPARATUS FOR BIAS ROLLING OF STRIP METAL

[75] Inventor: Josef Wochnik, Meerbusch, Fed. Rep. of Germany

[73] Assignee: SMS-Schloemann-Siemag, A.G., Dusseldorf, Fed. Rep. of Germany

[21] Appl. No.: 738,241

[22] Filed: May 28, 1985

[30] Foreign Application Priority Data

May 26, 1984 [DE] Fed. Rep. of Germany ..... 3419766

[51] Int. Cl.[4] ..... B21D 5/08; B21B 15/00

[52] U.S. Cl. ..... 72/177; 72/78; 72/124

[58] Field of Search ..... 72/177–179, 72/181, 182, 224, 91, 92, 78, 113, 124

[56] References Cited

U.S. PATENT DOCUMENTS

| | | | |
|---|---|---|---|
| 324,117 | 8/1885 | Kellogg | 72/124 |
| 2,429,052 | 10/1947 | Forbes, Jr. | 72/124 |
| 2,595,910 | 5/1952 | Wallace | 72/124 |
| 3,222,905 | 12/1965 | Ernestus | 72/91 |
| 3,274,814 | 9/1966 | Dilling | 72/124 |
| 3,348,401 | 10/1967 | Sporck | 72/178 |
| 3,718,021 | 2/1973 | Shein | 72/177 |

FOREIGN PATENT DOCUMENTS

| | | | |
|---|---|---|---|
| 276509 | 7/1914 | Fed. Rep. of Germany | 72/124 |
| 2924461 | 1/1981 | Fed. Rep. of Germany | 72/124 |

*Primary Examiner*—Daniel C. Crane
*Attorney, Agent, or Firm*—Russell & Tucker

[57] ABSTRACT

A process and apparatus for bias rolling of strip metal is provided wherein the strip stock is formed cylindrically and passed through a rolling station wherein roll passes formed by small diameter rolls traverse the stock on the bias along helical paths which successively overlap so that a uniform and flat rolled surface is formed.

3 Claims, 9 Drawing Sheets

APPARATUS FOR BIAS ROLLING OF STRIP METAL

FIELD OF THE INVENTION

This invention relates to the reduction of strip metal by rolling. It applies to both hot and cold rolling. More particularly it relates to methods and apparatus for rolling strip metal on an angle or on the bias.

BACKGROUND OF THE INVENTION

Strip metal has been conventionally reduced by rolling it along the longitudinal axis of the strip in succeeding roll stands the passes of which are on transversely extending lines. In one instance, however, rollers have been arranged to rotate in an orbital path and come down abruptly onto the strip, (see German Pat. No. 2622606). These latter devices have various disadvantages including severe treatment of the bearings, and causing dimples or waves on the surface of the strip.

A general object of this invention is to provide an improved strip rolling process and apparatus in which a multiplicity of small diameter rolls can be used with the concomitant increase in the efficiency thereof, but without at the same time sacrificing flatness and uniformity of surface of the strip. Another object is to provide a strip rolling process and apparatus in which the strip can be readily equalized and interchanged between concave or convex cross-section.

BRIEF DESCRIPTION OF THE INVENTION

In the accomplishment of these and other objects of the invention in a preferred embodiment, the strip is fed through a roll stand in which a multiplicity of work rolls arranged in radially aligned pairs define roll passes which are supported respectively on an inner central shaft and an outer planetary ring so as to orbit around the central axis as the strip stock in the form of a cylinder comes through. In this way the rolling action takes place on the bias, i.e. at an angle across the stock and the roll pressure paths follow parallel helical lines. It is a feature of the invention that the pressure paths of succeeding rolls overlap so that the entire surface of the strip is uniformly and flatly rolled. Another feature is that when the overlap is at least 50% rolling, efficiency is improved because each roll is then acting at least 50% on stock which has previously been rolled only shortly before. Still another feature is that a multiplicity of small work rolls can be employed with the concomitant efficiency advantages thereof. The process and apparatus are especially useful for the hot rolling of steel strip, but can also be used advantageously for cold or warm rolling as well as for copper, aluminum and other metals including continuously cast stock.

A feature of one embodiment is that the strip can be fed to the rolling station in the form of an elongated portion of the surface of a segment of a cylinder and reduced by the action of roll passes orbiting in a plane normal to the axis of the strip. In another embodiment two or more strips can be fed in barber pole fashion around the surface of a rotating mandrel. In this latter embodiment, the orbital motion of the roll passes is on a plane set at an angle to the motion of the stock, but the bias rolling principal and the overlap of the pressure paths of the respective roll passes is the same. A feature, however, of latter embodiment is that the cylindrical form of the stock takes the shape of a helix rather than extending longitudinally of the stock.

BRIEF DESCRIPTION OF THE DRAWINGS

Further objects and features of the invention will best be understood with reference to the following description of the invention illustrated in the drawings in which.

DETAILED DESCRIPTION OF THE INVENTION

Figure 1:
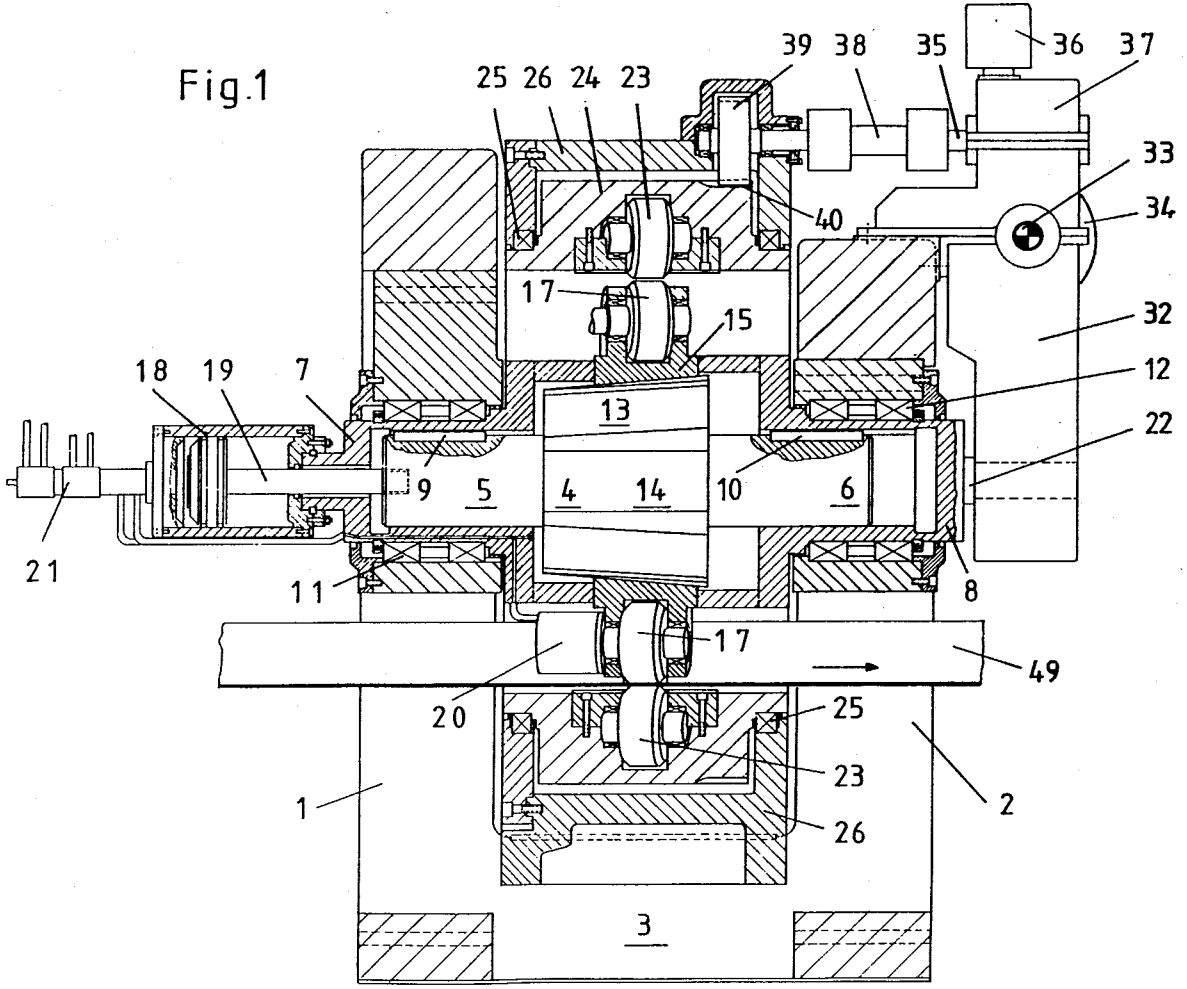
FIG. 1 is a view in longitudinal section of an embodiment of the invention.
Figure 2:
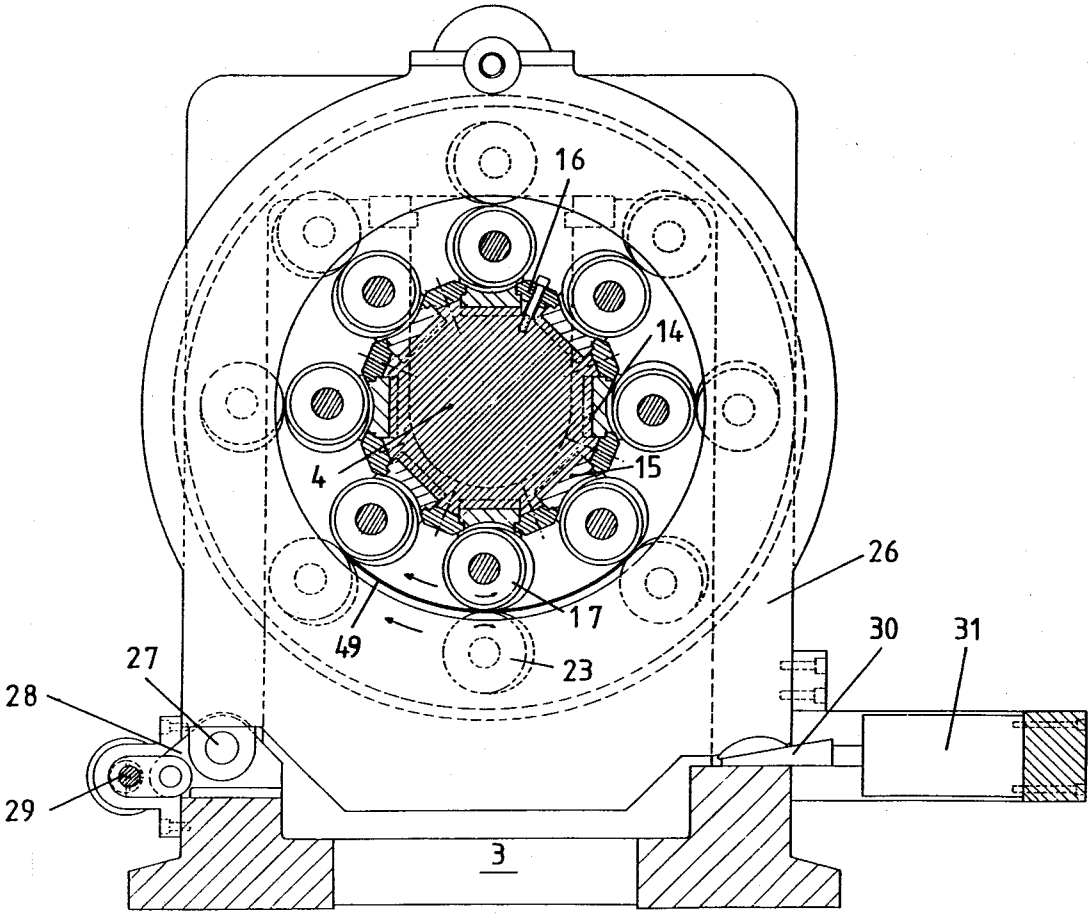
FIG. 2 is a cross-section of the embodiment of FIG. 1.

The illustrative embodiment therein shown of a mill for rolling strip metal on the bias is mounted on a base frame 3 having side supports 1, 2. Chocks 11, 12 are mounted respectively on side supports 1, 2 and serve as a base for shaft housings 7, 8 in which journals 5, 6 are mounted for longitudinal but not rotational movement and held in place by springs 9, 10 in key ways. The journals 5, 6 support a central shaft 4, on which is mounted a tapered (truncated conical) member 13 having eight symetrically, circumferentially disposed grooves 14 in each of which is slidably mounted a work roll supporting shoe 15 on which a work roll 17 is mounted.

A hydraulic ram comprising cylinder 18 and piston 19 is mounted coaxially at the end of shaft housing 7 for the purpose of moving the journals 5, 6 together with the central shaft 4 longitudinally so as to move the shoes 15 in grooves 14 and thereby to control the radial distance of all eight work rolls 17 from the axis of shaft 4 simultaneously. Hydraulic fluid is supplied to cylinder 18 by a double rotary valve 21 which also serves to supply regulated fluid in series to hydraulic motors 20 each of which drives each of the work rolls 17. Central shaft 4 is driven by a gear-actuated shaft 22 which communicates through housing 8 with shaft 4.

Each work roll 17 acts against a corresponding external work roll 23 mounted in a planetary ring 24 coaxially with shaft 4, on roller bearings 25 supported by an outer housing 26.

Figure 3:
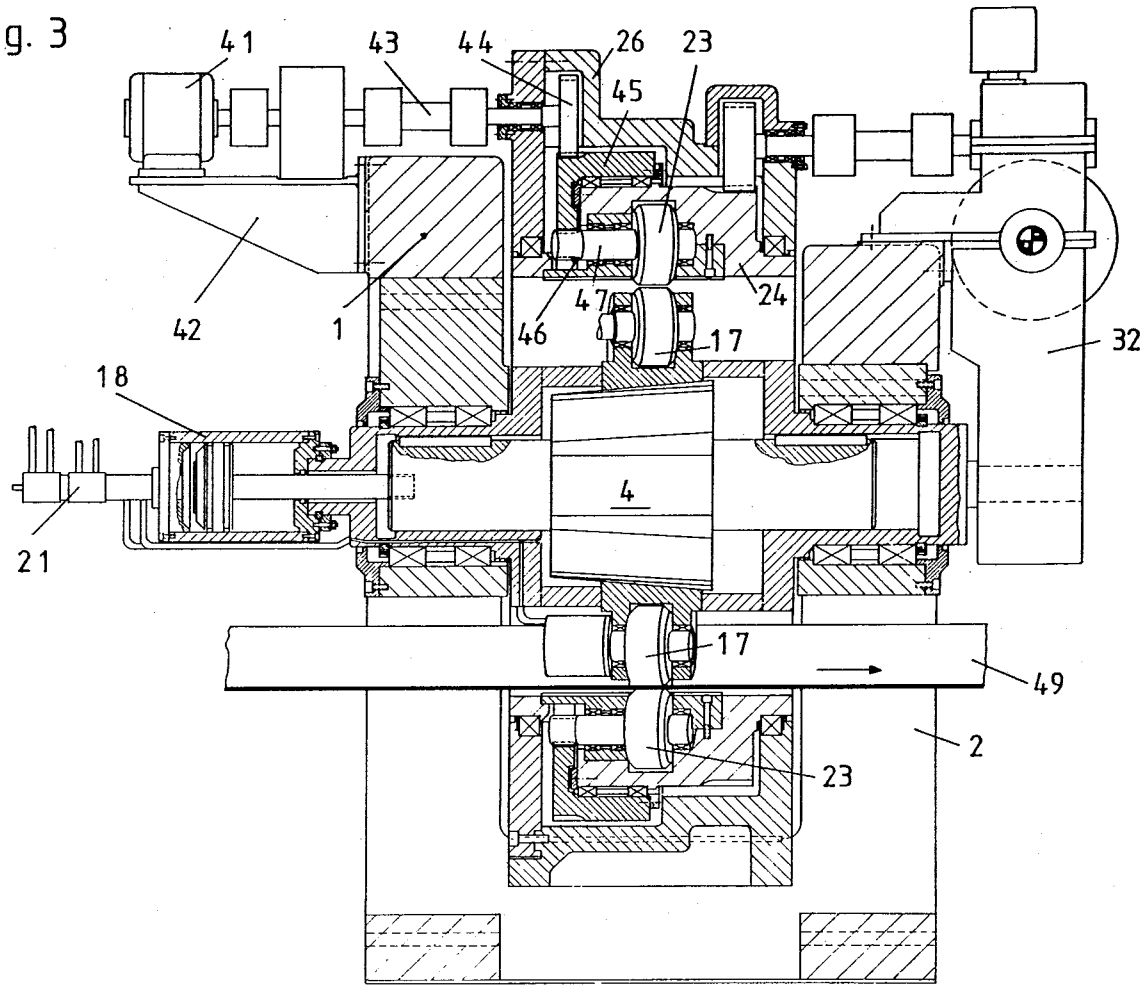
FIG. 3 is a longitudinal section similar to FIG. 1 but showing an additional drive for the outer work rolls.

In order to adjust housing 26 horizontally relative to central shaft 4, the lower side portion of housing 26 is mounted on a bolt 26 (see FIG. 3) with a bracket 28 arranged with an eccentric drive 29 to move housing 26 horizontally. Vertical adjustment of housing 26 is achieved by means of a wedge 30 acting under the control of a hydraulic ram 31 on the opposite side of housing 26 to raise and lower the housing 26.

A motor 34 is mounted on side plate 2 arranged to drive a shaft 33 which in turn drives a branching gear 32, to turn shaft 22 (and hence central shaft 4) through stationary housing 8. A further, motor 36 is mounted above motor 34 and serves to drive planetary ring 24 around the axis of central shaft 4 by means of a shaft 35 acting through intermediate shaft 38 and a pinion 39 mounted in housing 26 and meshing with gear teeth 40 in the external surface of the planetary ring 24. These drives are locked in synchronism so that the inner work rolls 17 and outer work rolls 23 are maintained precisely in tandem to form a rolling nip or bite therebetween in the plane of the stock.

In the embodiment shown in FIG. 1 the outer work rolls 23 rotate merely under the influence of friction. They can, however, be driven by mechanism shown in FIG. 3. This is done by providing each outer work roll-23 with a drive shaft 47 having a helical gear 46 at its end which is in turn driven by gear teeth on an internal planetary gear ring 45 coaxial with center shaft 4. Ring gear 45 is driven by a pinion 44 on shaft 43 which is in turn driven by motor 41 mounted on side support 1 on a bracket 42.

Figure 4:
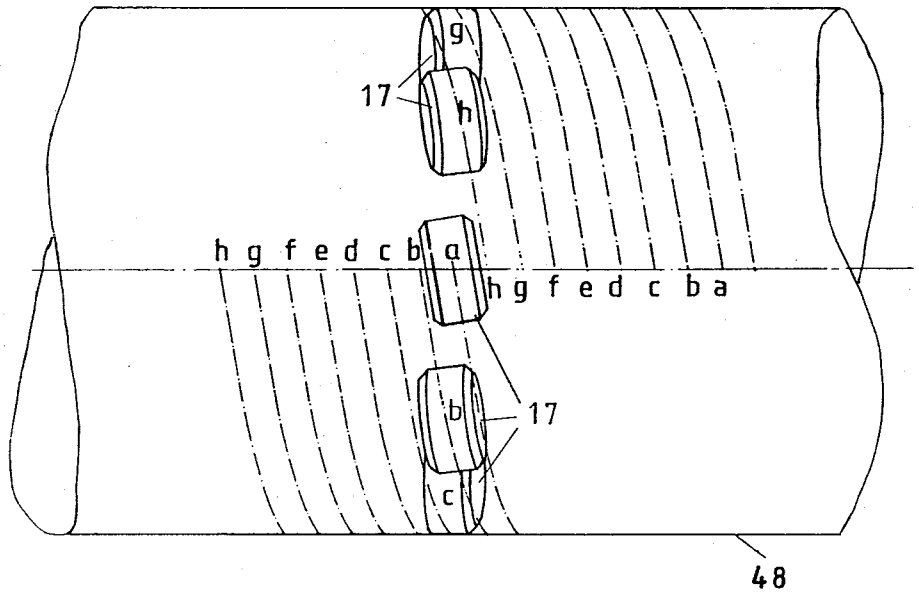
FIG. 4 is a diagramatic view illustrating the pressure paths of the work rolls.

The rolling operation is diagramatically illustrated in FIG. 4 in which only inner work rolls 17 are shown. It will be understood outer work rolls 23 will act against work rolls 17 so as to form a rolling nip or bite therebetween bearing against the stock. It will also be understood that the strip stock advances axially in a cylindrical path as designated at 48 and that the work rolls 17 traverse the stock along helical lines as designated at a to k. An important feature is that the contact paths between the respectively consecutive work rolls 17 and the stock, extend transversely of the stock at an angle $\alpha$ to a plane normal to the axis of shaft 4. This angle is referred to herein as the bias angle of rolling.

Since the stock is in the form of a longitudinal section of a cylinder and the work rolls 17, 23 are set at the bias angle of rolling, the nip is not a straight line but is curved slightly depending on the bias angle and the radius of the stock cylinder. Therefore, ideal contact between work rolls 17, 23 and the stock requires work rolls 17 to be commensurately convex and work rolls 23 to be complementarily concave. To be precise, the curve is a segment of an ellipse.

The relationship between the bias angle, the rotational rate of work rolls 17, 23, and the rotational rate of shaft 4, are gauged so that, as the work rolls traverse the stock, the stock is advanced axially of cylinder 48. Also it is important that the width (axial length) of work rolls 17, 23 in relation to the spacing between successive pairs, and the ratio of axial advance to rotational rate, are such that the successive contact paths overlap. In this way, a complete and gapless rolling coverage of the strip surface is accomplished.

In one embodiment, the successive paths are gauged so that each path overlaps the proceeding one by at least 50%. In this way, each roll pass acts 50% on fresh stock to start plastic deformation and thereby to exceed its elastic limit, and 50% on stock which has very shortly beforehand been rendered plastic by the next ahead roll pass. This makes for more efficient rolling in that more forward slip in the stock is accomplished in the second 50% or more in the axial direction of the stock for the same expenditure of energy. This feature applies especially to hot rolling but is advantageous in warm rolling (400° C. to 550° C.) and even in cold rolling.

It is not necessary, however, to have this exact double overlap to gain material advantages of the invention as long as there is sufficient overlap to roll all parts of the stock and thereby to provide a resulting product which is uniformly thick and flat. While the overlap is achieved in the embodiments shown by the use of a single set of work rolls arranged on a single plane transverse to the axis of shaft 4, it will be understood that the overlap can be achieved by using one or more sets of work rolls arranged on planes axially removed upstream or downstream of the work rolls herein shown, without departing from the spirit of the invention. The bias angle of the work rolls in a suceeding plane or planes will, of course, have to be adjusted to account for the forward slip of the proceeding roll passes.

Figure 6:
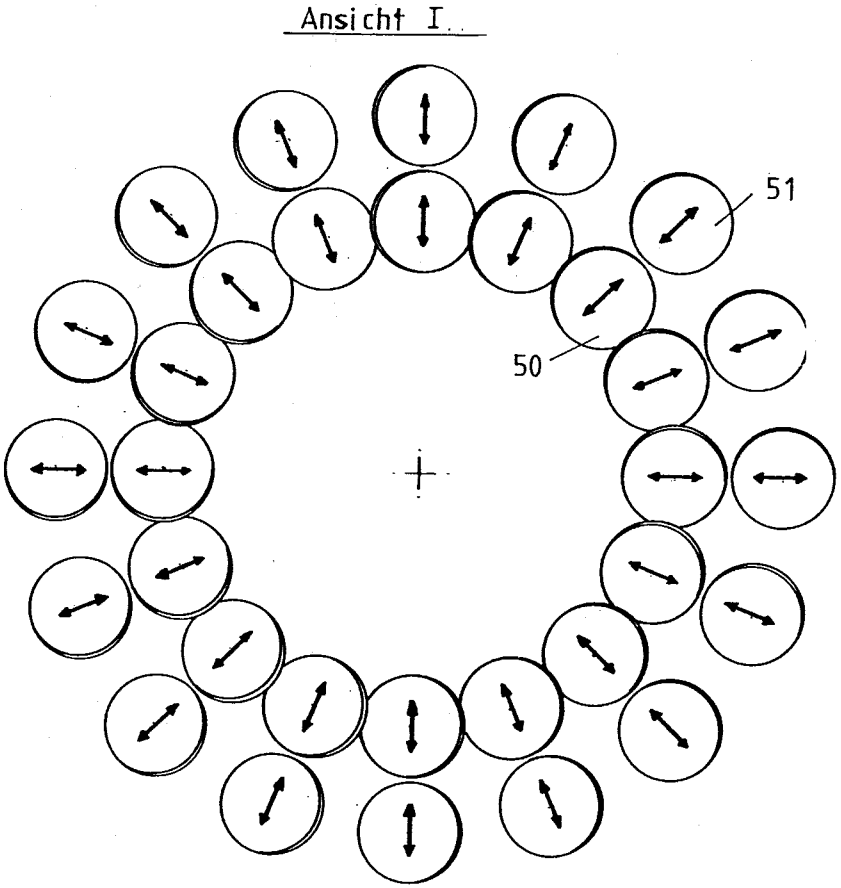
FIGS. 5 and 6 are diagramatic views of a staggered arrangement of disk-like work rolls.
Figure 5:
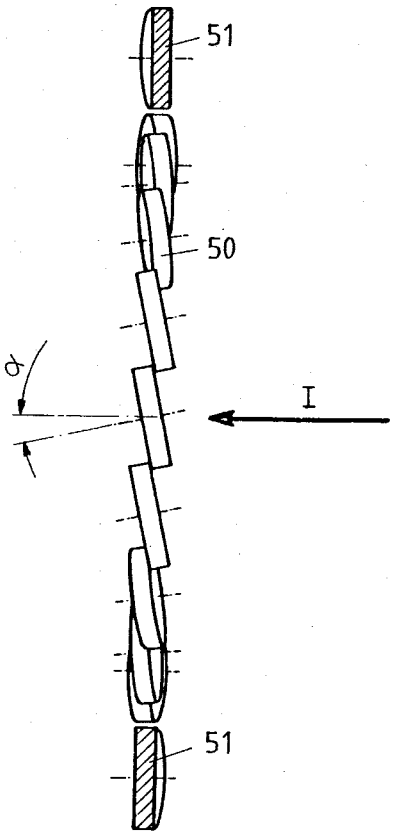

Another way to increase the overlap is to reduce the diameter of the work rolls 17, 23 and employ more of them as diagramatically illustrated in FIGS. 5 and 6. This has the advantages of increasing the angle of bite, and reducing the rolling angle, the contact area, and the friction, which combine to give more forward slip for a given expenditure of energy.

Figure 8:
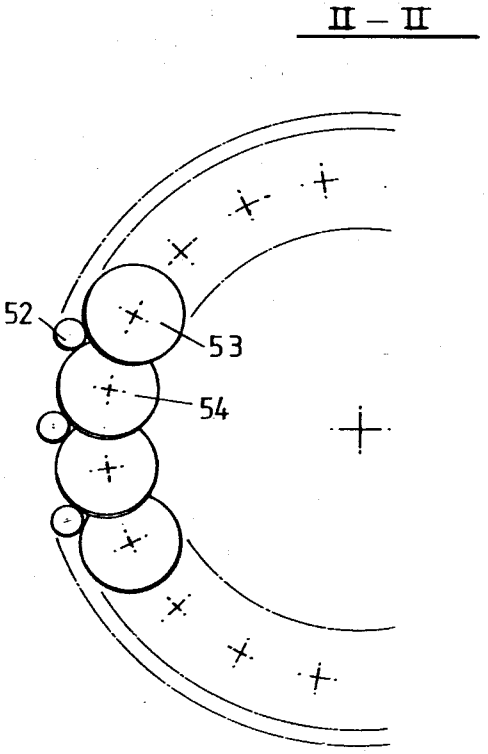
FIGS. 7 and 8 are diagramatic views showing a further arrangement of work rolls supported by backing rolls.
Figure 7:
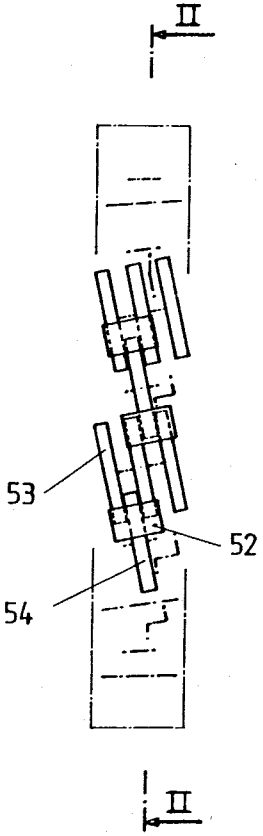

A way to obtain even smaller work roll diameter is shown diagramatically in FIGS. 7 and 8, in which backup rolls 53, 54 are employed to support small work rolls 52. Similar but complementary supports for work rolls to form a roll pass with rolls 52 are assumed and need not be described.

Figure 9:
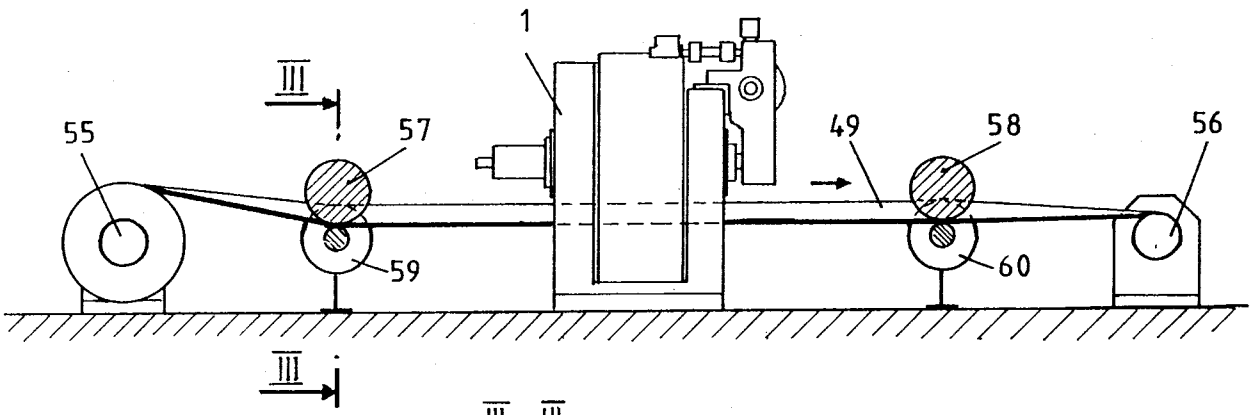
FIG. 9 is a view in longitudinal section of an embodiment for conveying the strip to the rolling station in cylindrical fashion.
Figure 9A:
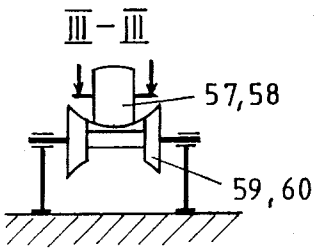
FIG. 9A is a cross-sectional view of the embodiment of FIG. 9 taken along the line III—III.

FIG. 9 shows a device for bending the strip stock 49 to form the desired cylindrical shape. It employs a pay-off reel 55 from which the stock is fed through a bender comprising an upper convex roll 57 acting against a pair of spaced concave roll sections 59. From there the stock passes through the bias rolling mill and thence through a second convex, concave pair of rolls 58, 60 identical to rolls 57, 59, and out to a take up reel 56. The two pairs of convex-concave rolls hold the stock in the desired cylindrical shape while it passes through the bias rolling mill so as to correspond to the orbital paths of work rolls 17, 23.

Figures 10, 10A:
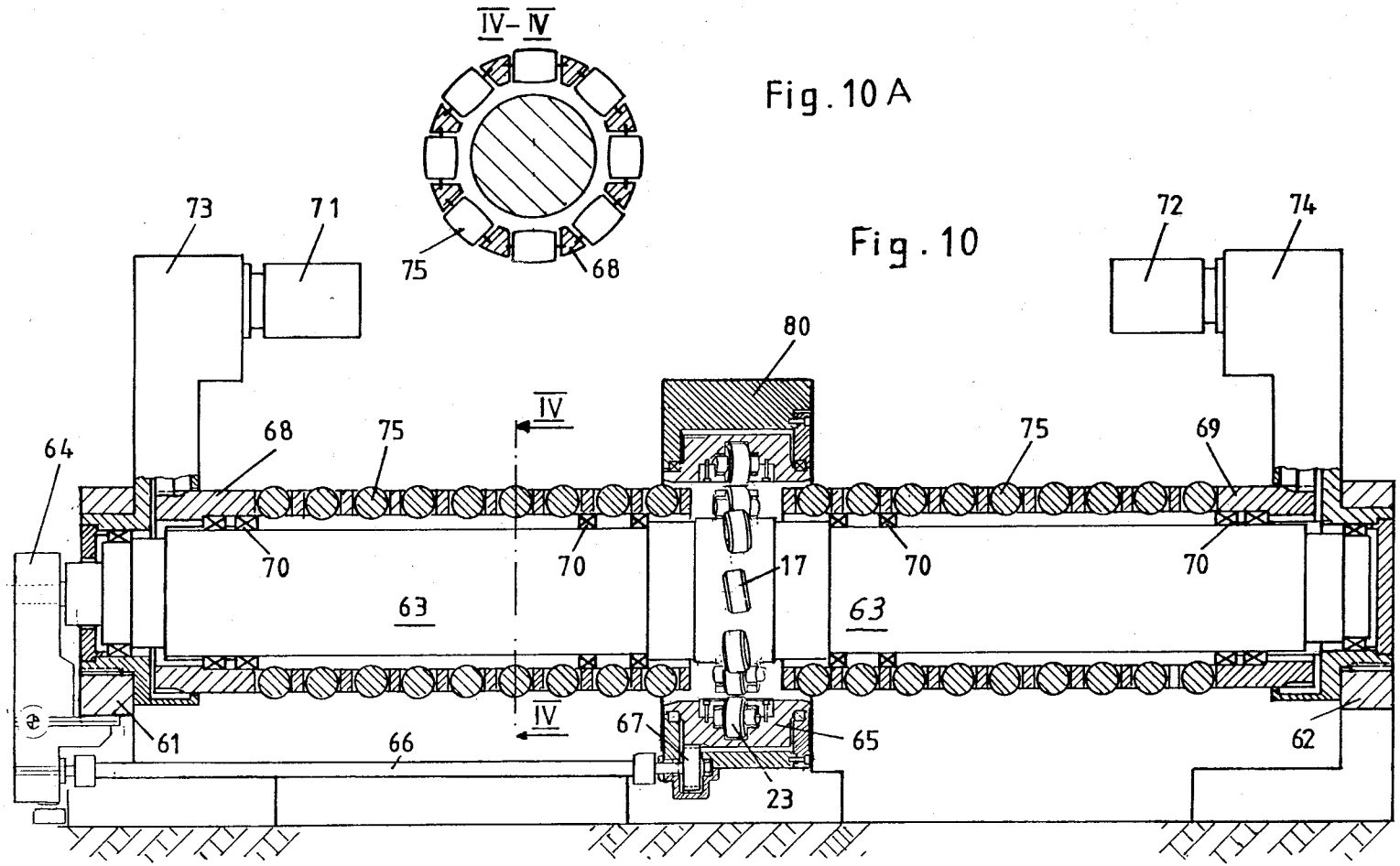
FIG. 10 is longitudinal section of the embodiment for feeding the strip to the rolling station in barber pole fashion.
FIG. 10A is a cross-sectional view of the embodiment of FIG. 10 taken along the line IV—IV.
Figure 11:
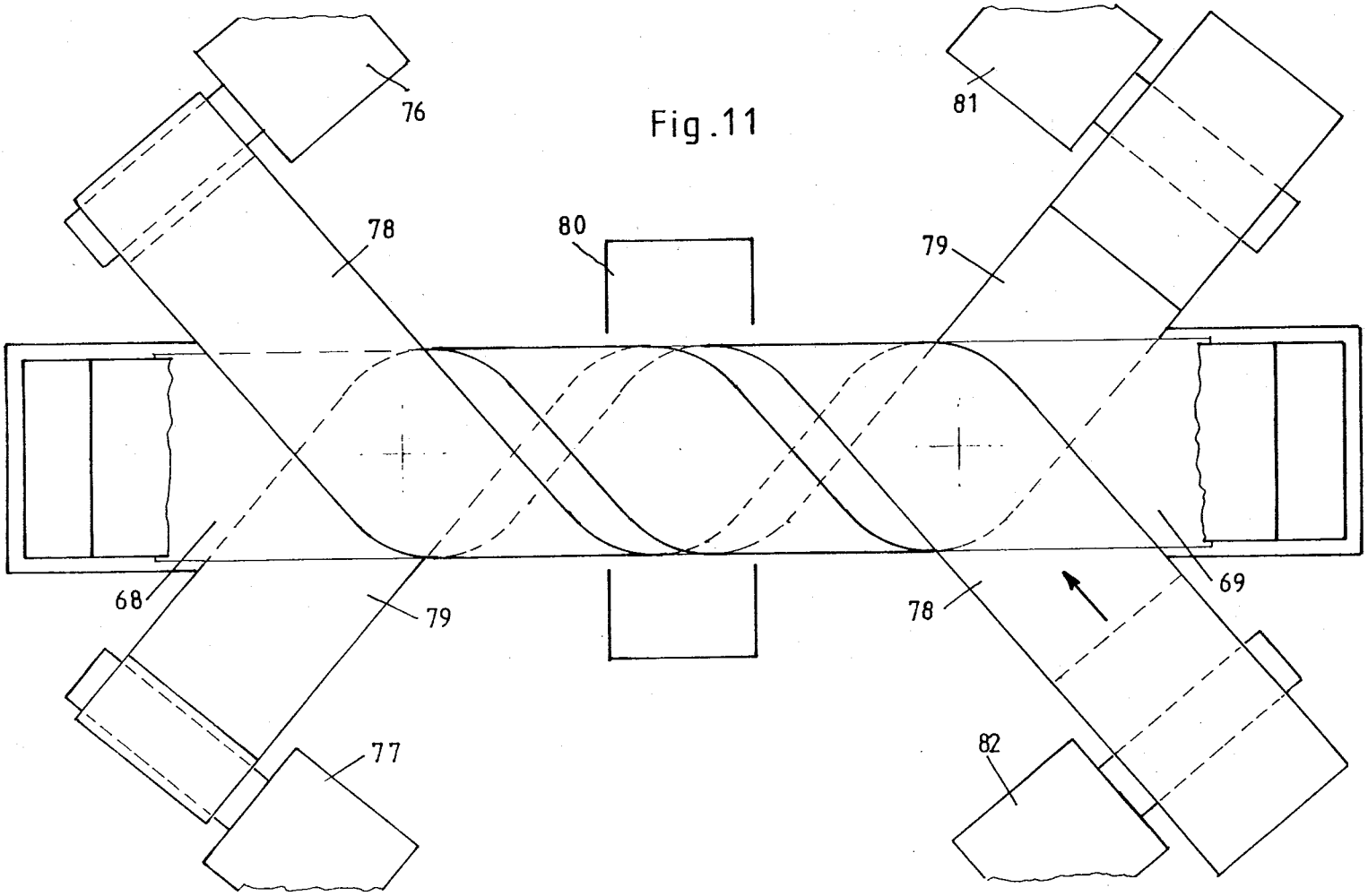
FIG. 11 is a diagramatic view showing how the strip is fed to the embodiment of FIG. 10.

A further embodiment of the invention is shown in FIGS. 10 and 11 in which two strips are fed simultaneously through the bias rolling mill. This is done by supporting the inner work rolls 17 on a long central shaft 63 mounted in bearings on end supports 61, 62. A branching gear 64 is provided at support 61 to drive both the shaft 63 and, through a shaft 66 and pinion 67, a planetary ring 65 carrying outer work rolls 23. In this case neither inner work rolls 17 nor outer work rolls 23 are driven, although it will be understood that a drive for them can be provided if desired.

Cylindrical mandrels 69, 68, coaxial with shaft 63, are provided respectively to guide the strip from pay-off reels up to the bias rolling mill and from there to take-up reels. Mandrels 69, 68 are respectively driven in rotation by gears 74 and 73 acting in response to motors 72, 71. In order to facilitate longitudinal motion of the respective stock strips along mandrels 69, 68, closely spaced roller bearings 75 are distributed around the surfaces of both mandrels.

As is illustrated diagramatically in FIG. 11, strips 78, 29 are fed from pay off reels 82, 81 around the mandrel 69 through the bias rolling mill, over mandrel 68 and out to take-up reels 78, 79 respectively. In this way the bias rolling mill acts respectively equally on the two strips simultaneously on opposite sides of the mill. Additional strips an be added in a star configuration if desired.

Mandrel 69 is driven by motor 72 and gear 74 at a rate fixed in relation to the rotational rate of shaft 63 and the bias angle of work rolls 17, 23 is selected to provide the least friction between the strip stock and work rolls 17, 23. The rotational rate of mandrel 68 is, of course, faster due to the forward slip of the stock, and is gauged only to maintain tension.

Since the line of the bite between work rolls 17, 23 follows a curve determined by the radius of mandrel 68 and the bias angle, it is preferable, as above indicated, to make work rolls 17 correspondingly convex and work rolls 23 concave, although flat rolls can be used especially if a large number of them is employed as in FIG. 8.

Figure 12:
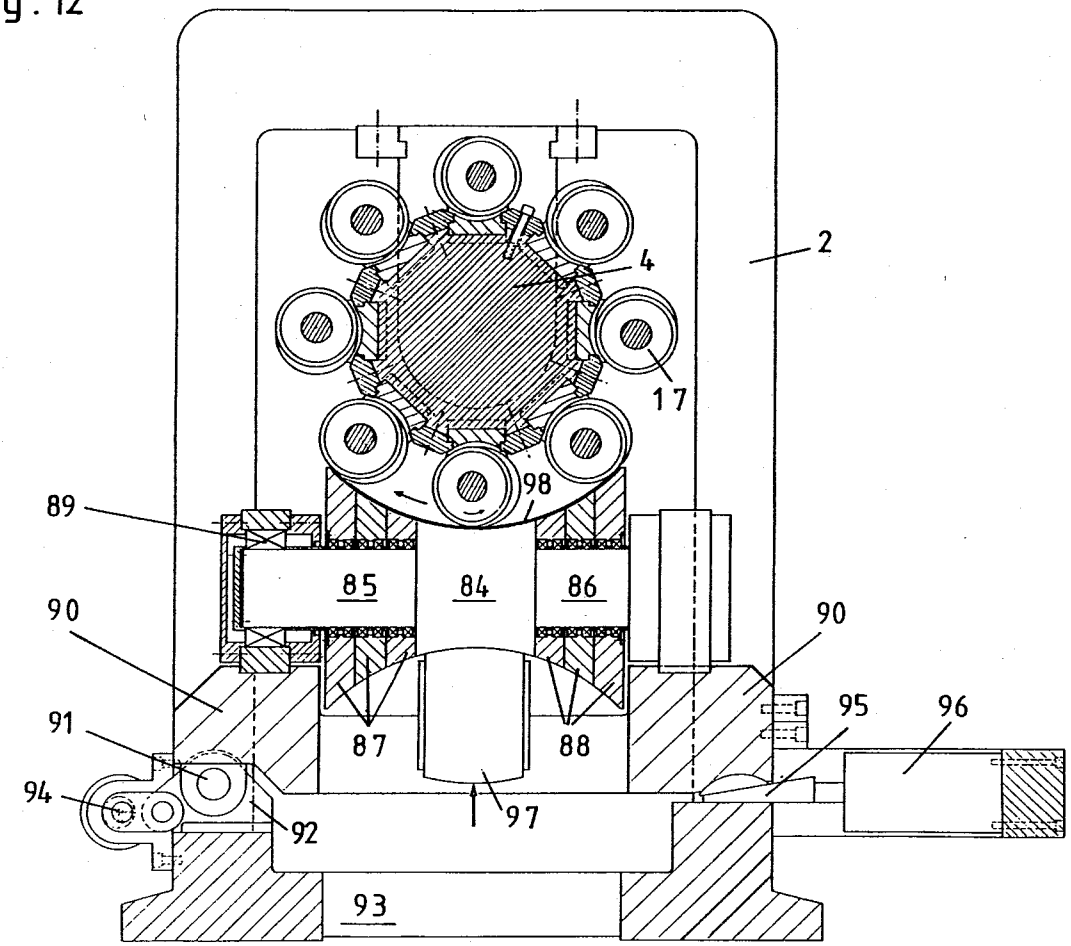
FIG. 12 is a view in cross-section of a variant employing a single concave backing roll to form one side of the roll passes.
Figure 13:
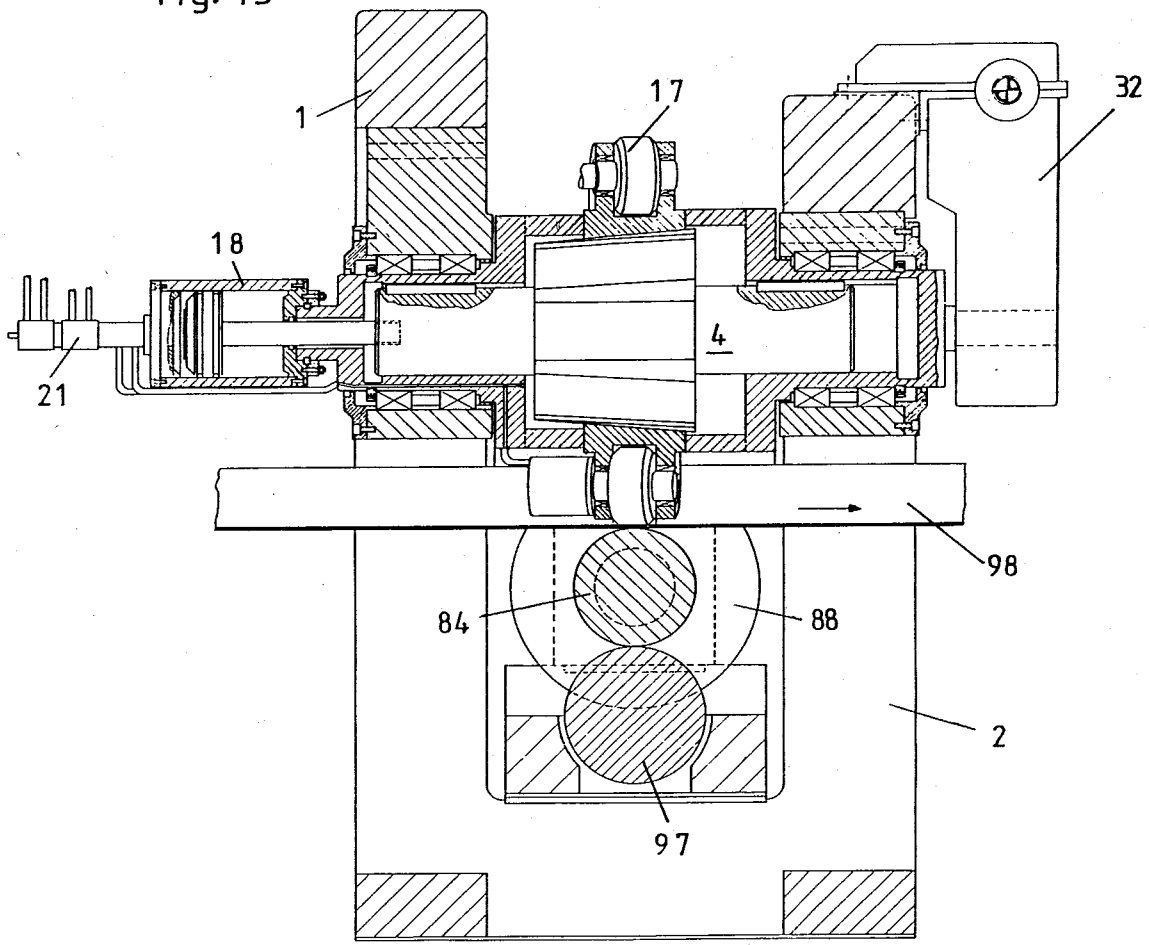
FIG. 13 is a longtiudinal section of the variant of FIG. 12.

In another embodiment shown in FIGS. 12 and 13, the external work rolls 23 are replaced by a multipart concave backing roll 84-88, the face of which corresponds to the contour of the stock. The backing roll 84-88 includes freely pivoting roll sections 87, 88 on journals 86. The backing roll 84-88 is supported on roller bearings mounted on base members 90 which are movable horizontally by means of bolt 91 and eccentric drive 94. Vertical adjustment is attained by means of wedge 95 driven by hydraulic ram 96 acting to lift on the opposite side of support 90. In this way the concave backing roller 84-88 can be adjusted relative to the orbit of work rolls 17 to provide the desired rolling stock profile. Backing roller 84-88 is supported from below by a support roller 97 which bears only against central portion 84 of the roller 84-88.

Figure 14:
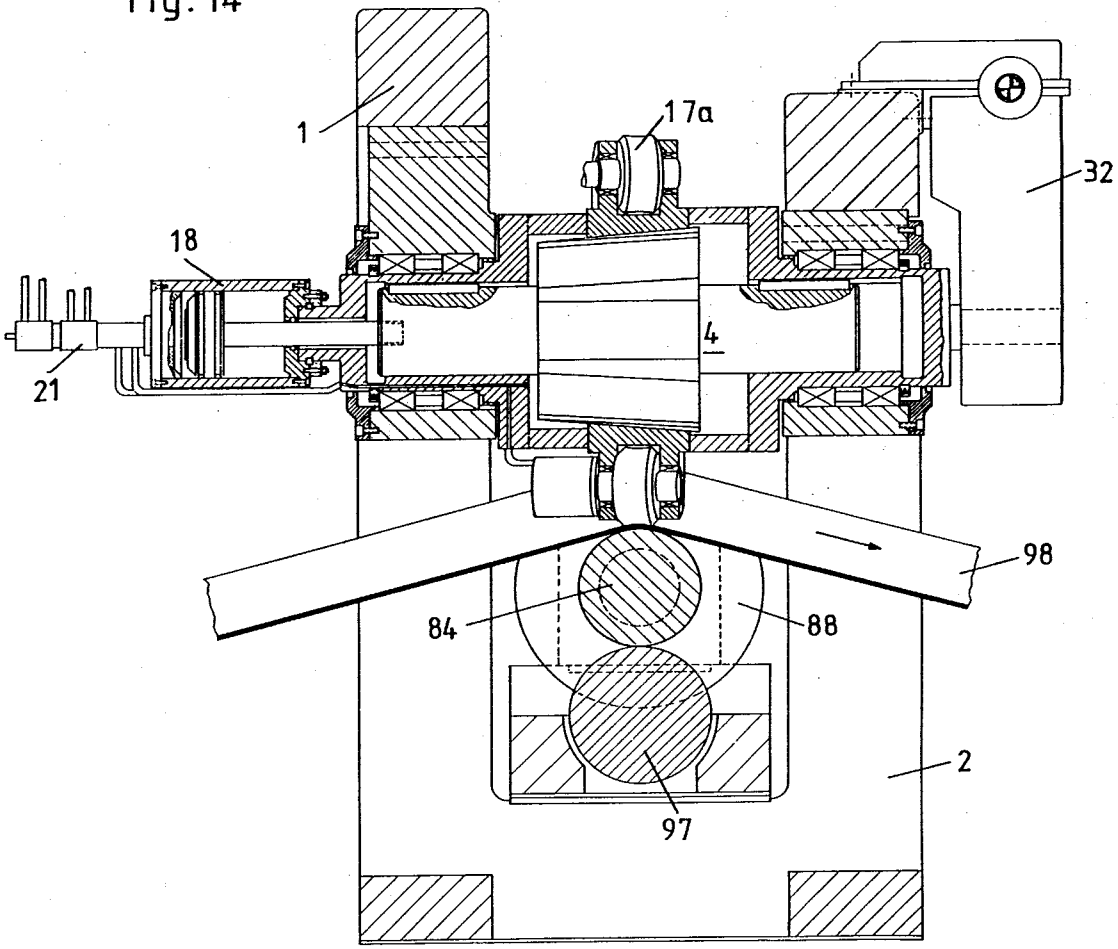
FIG. 14 is a longitudinal section of the variant of FIG. 12 but with the stock being bent downwardly.

A further embodiment is shown in FIG. 14 in which the stock is held under tension and is bent downwardly around concave roller 84-88. In this instance work rolls 17 are provided with correspondingly concave faces (depending on the respective radii and bias angles). Whereby a particular flat rolled strip is attained.

In view of the various embodiments described numerous other variants will now be apparent to those skilled in the art. Therefore, it is not intended to confine the invention to the precise forms herein shown but rather to limit it to the terms only of the appended claims.

I claim:

1. Apparatus for rolling strip metal stock on the bias comprising:

means for continuously forming strip stock into a portion of a cylinder and feeding it to a rolling station;

means at said station of rolling said stock comprising at least one pair of rollers having relatively fixed substantially parallel axes mounted in journals in opposed relation to form a nip therebetween;

means for driving at least one of said pair of rollers;

means for moving said nip in a planetary path the radius of which is equal to the radius of said portion of a cylinder, the roller axes of said roller pair being located on the same radial line, said pair of rollers remaining fixed relative to one another throughout their movement in the planetary path;

means for guiding said stock to said nip along a desired stock formation line;

the axis of said rollers set so that said nip forms a bias angle relative to the motion of said stock and means for controlling the driven rotational rate of said rolls in relation to both the rate of the planetary motion of said nip and said bias angle of said nip, to draw the stock through said nip along the desired stock formation line.

2. The apparatus defined in claim 1 further characterized by:

a multiplicity of said pairs of rollers are provided in said rolling station, and means for maintaining at least one said pair in contact with said stock at all times.

3. The apparatus defined in claim 1 further characterized by:

said rollers are contoured to form said nip into a line of contact with said stock.

* * * * *